United States Patent [19]

Steenken et al.

[11] 3,975,841

[45] Aug. 24, 1976

[54] SHIP AND PIER FOR EXTRACTION OF VALUABLE MATERIALS FROM THE SEA BED

[75] Inventors: Heinz W. L. Steenken, Reinbek; Detlef G. H. Lüth, Hamburg, both of Germany

[73] Assignee: Howaldtswerke-Deutsche Werft Aktiengesellschaft Hamburg und Kiel, Hamburg, Germany

[22] Filed: Apr. 15, 1975

[21] Appl. No.: 568,317

[30] Foreign Application Priority Data

Apr. 20, 1974 Germany ..... 2419056

[52] U.S. Cl. ..... 37/54; 114/.5 BD; 214/13; 299/9

[51] Int. Cl.[2] ..... E02F 7/02

[58] Field of Search..... 114/.5 BD, 435 R, 43.5 VC; 214/13; 9/8 P; 299/8, 9; 37/54

[56] References Cited

UNITED STATES PATENTS

| | | | |
|---|---|---|---|
| 2,699,321 | 1/1955 | Nelson | 114/43.5 VC |
| 3,522,670 | 8/1970 | Flipse et al. | 299/8 X |

*Primary Examiner*—Ernest R. Purser

*Attorney, Agent, or Firm*—Stevens, Davis, Miller & Mosher

[57] ABSTRACT

Valuable materials, such as manganese, are extracted from the sea bed by propelling through the sea a buoyant body which floats on the sea and carries equipment for extracting the material from the sea bed. A pier connected to the body affords moorings for transport ships which receive the extracted material and conveyor devices associated with the pier deliver the material directly into the ships. The transport ship or ships provide part of the propulsion force for the buoyant body.

4 Claims, 7 Drawing Figures

SHIP AND PIER FOR EXTRACTION OF VALUABLE MATERIALS FROM THE SEA BED

BACKGROUND OF THE INVENTION

It has recently been discovered that regions exist, particularly in the Pacific Ocean, where valuable sea bed materials are deposited, particularly in the form of lumps of manganese, which constitute a valuable product which can be utilised for various branches of technology.

For the purpose of transporting sea bed material particularly in the form of lumps of manganese, it is intended to gather such material with the aid of floating bodies and conveyor devices, that is to say a floating body which is provided with a conveyor device and which is moved over strips of the sea bed, the valuable sea bed materials, particularly in the form of lumps of manganese, being conveyed on to the floating body by means of suction or pressure means.

It is desired to achieve the greatest possible continuity of conveying and of transporting the valuable sea bed materials collected.

It is an object of the invention to provide apparatus for extracting valuable sea bed materials, which apparatus serves the purpose of continuous conveying of the sea bed materials and ensure the greatest possible continuity of transport of the sea bed materials extracted, while achieving a rational utilisation of available energy and a method of extracting such material.

SUMMARY

According to the invention apparatus for extracting valuable materials from the sea bed comprises a body capable of floating on the sea and carrying equipment by which the material can be extracted from the sea bed during propulsion of the body thereover, a pier adjoining and connected to the body and arranged to permit the mooring thereto of transport ships to receive the material, and conveyor devices associated with the pier and arranged to convey the material from the body directly into a ship moored to the pier and body.

In one embodiment of the invention the buoyant body or conveyor island may be so developed in respect of its shape that it is suitable for the mooring of at least one transport ship, and for this purpose there is fastened to the floating body, which is in the form of a conveyor island, a pier to which at least one transport ship can be coupled along its longitudinal side, while on the pier. The conveyor devices may be conveyor belts, chutes, or slides by which the conveyed bulk material is delivered direct into the body of a transport ship.

In order to utilise a part of the driving power of a transport ship (or a plurality of transport ships) for propelling the body, one or more abutments for coupling a transport ship to the body joined to the pier may be provided. This abutment, or these abutments, may be made adjustable for the purpose of adaptation to the type and size of the transport ship.

In one embodiment the body has the shape of a ship's hull, the pier adjoins and is connected to the hull, and the pier is disposed symmetrically to the axis of the body.

In this case the construction is preferably such that the widened portion of the body contains the conveyor equipment for the bulk material from the sea bed, together with the necessary energy generators for driving the body and drive sources for the conveyor devices provided on the pier.

In another embodiment the body and pier as viewed in plan have the general form of an arrow, the body forming the head of the arrow and the pier forming the shaft of the arrow.

An arrangement of the kind set forth above makes it possible for at least two transport ships to be moored on the two sides of the pier, in which case one transport ship is then continuously loaded with the bulk material while for the transport ship moored on the other side of the pier the necessary arrangements are being made for the delivery of bulk material to this ship.

In this way continuous loading and continuous conveying of the bulk material is possible.

The abutments for the mooring of at least one transport ship to a part of the body may be disposed in suitable positions on the body. In a preferred embodiment of the invention the body is tapered in the direction of the pier and the abutments are disposed on the tapering portions.

The invention also provides a method for the conveying of bulk materials gathered from the sea bed, particularly lumps of manganese, wherein the driving power of one or more transport ships is used also for the propulsion of the body, in such a manner that the entire installation comprising the body and the parts associated with it can be so designed that their main power is used for conveying bulk material from the sea bed, while the driving power of the transport ship, which is not required for other purposes during the loading or feeding of a transport ship, can also be used for propelling the body.

This method comprises the steps of forming a navigable unit by mooring at least one transport ship to apparatus as set forth above deriving at least a part of the propulsion force for the body from the drive of at least one transport ship moored thereto, moving the unit over the sea bed while extracting material therefrom, and conveying the extracted material directly into the ship or ships.

In one embodiment of the method the bulk material extracted from the sea bed can be continuously delivered direct into at least one transport ship, while any excess water is then drawn off from the transport ship.

The method may also include the steps of freeing the extracted material, particularly lumps of manganese, from impurities, and subjecting the material to preliminary dressing before discharge thereof into the transport ship or ships.

DESCRIPTION OF THE PREFERRED EMBODIMENT

Figure 5:
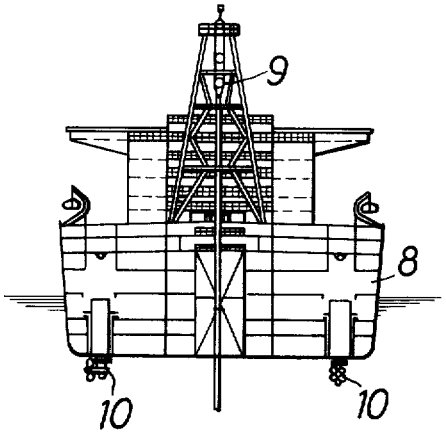
FIG. 5 is a cross-section through the front part of the body.
Figure 6:
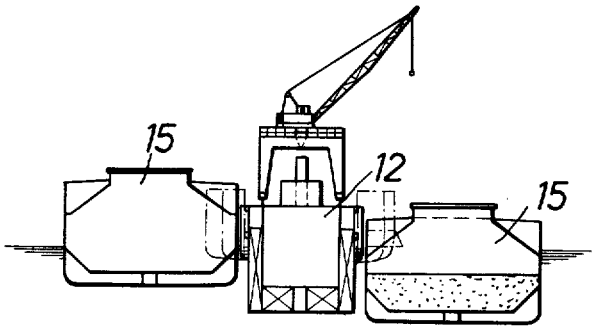
FIG. 6 is a cross-section through the middle of the body with two transport ships.

Referring to the drawings, a buoyant body or conveyor island is indicated generally by the reference 8 and in the construction illustrated has the approximate form of the shape of a ship's hull (see FIG. 2), on which the equipment necessary for the conveying of bulk materials from the sea bed are provided, as indicated for example at 9. In the buoyant body 8, which is capable of floating on the sea, the energy sources necessary for propelling the ship and for other purposes are also disposed. Two front drive propellers or screws 10 are indicated in FIG. 5.

Figure 1:
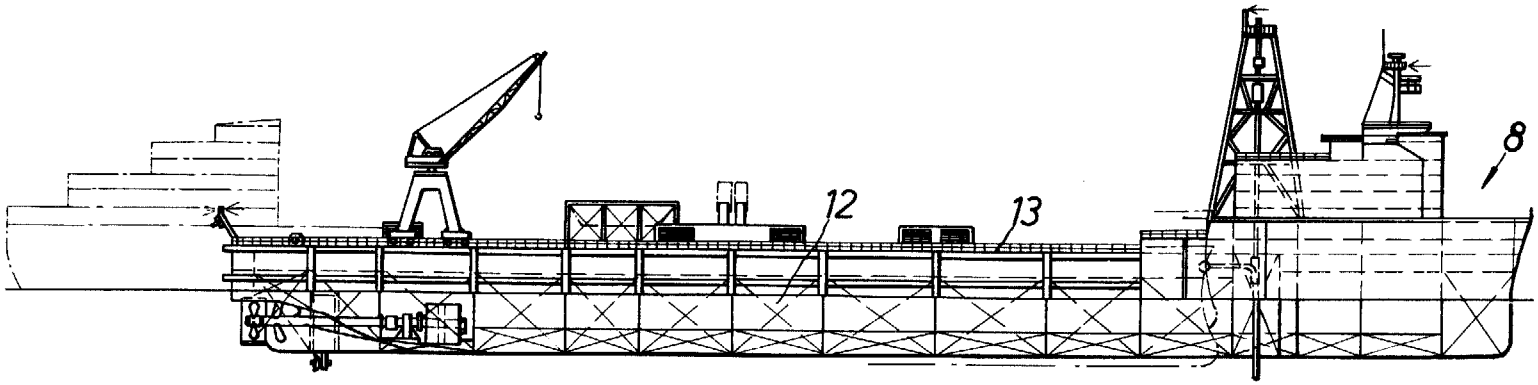
FIG. 1 is a longitudinal section through apparatus according to the invention.
Figure 2:
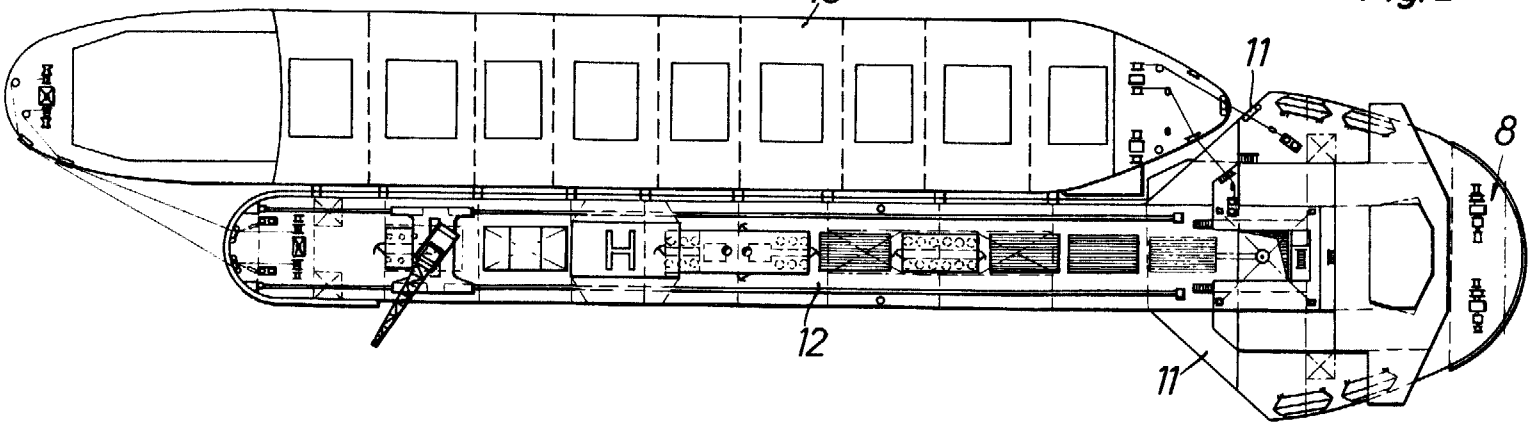
FIG. 2 is a plan view of the apparatus and a transport ship coupled to it.
Figure 7:
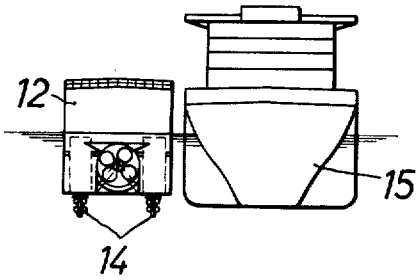
FIG. 7 is a view from the stern of the body, in conjunction with the stern of a transport ship.

The body 8 tapers aft, as indicated at 11 in FIG. 2, and merges into a pier 12, which pier is provided with conveyor means 13, FIG. 1, for transporting the conveyed materials to individual discharge sections. In the embodiment illustrated the pier 12 is disposed symmetrically to the axis of the body 8, at its aft end it is provided with a double-screw drive 14, as can be seen in FIG. 7. The body 8 and pier 12 as viewed in plan, FIG. 2, have the general form of an arrow, the body 8 forming the arrow head and the pier 12 forming the shaft of the arrow.

Figure 3:
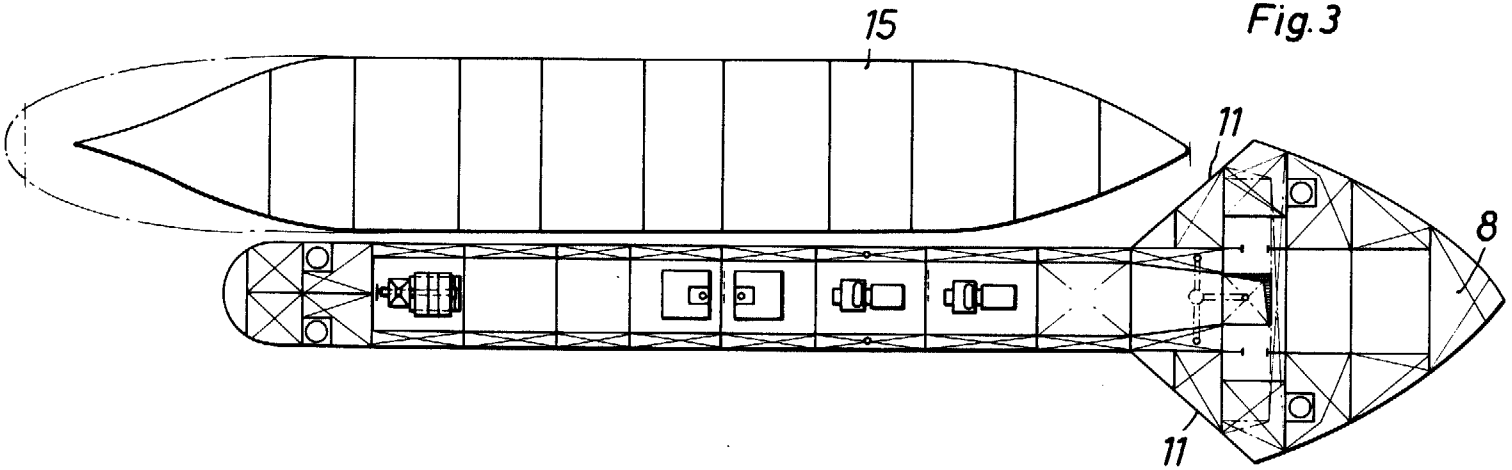
FIG. 3 is a view similar to FIG. 2, in the form of a space plan.
Figure 4:
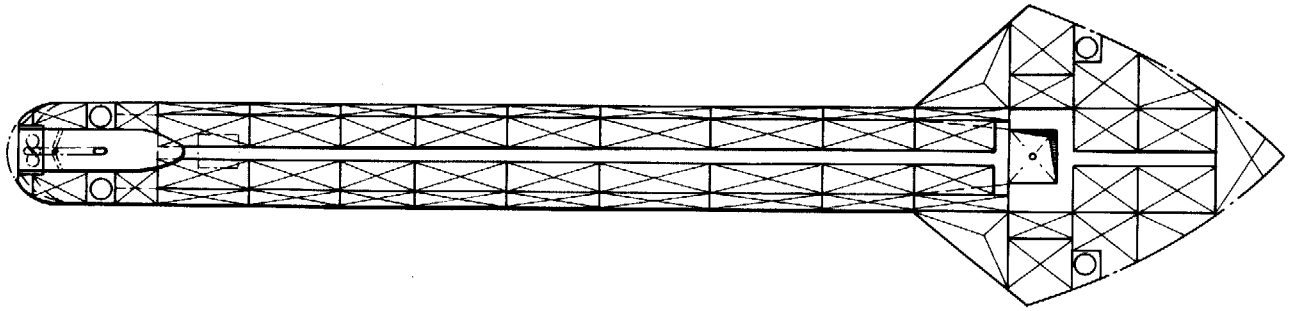
FIG. 4 is a longitudinal section through the double bottom of a body forming a part of the apparatus.

As can be seen in FIGS. 2 and 3, a transport ship designated 15 is indicated laterally of the pier 12, this ship containing a number of tanks or compartments for receiving bulk material. The arrangement is such that the transport ship 15 can be coupled to the pier 12, and for this purpose abutments (not shown) for frictional connection of the transport ship to the body 8 can be provided on the tapering walls 11 of the body 8.

When the apparatus is in use the conveyor equipment 9 delivers bulk material extracted from the sea bed in an upward direction and the material is passed on to the conveyor means 13, from which it is transferred at various suitable points directly into the transport ship 15. During the operation of conveying the bulk material into the transport ship 15 another ship can tie up to the other side of the pier 12 and, after being moored to the pier 12, can in turn be loaded after the first transport ship 15 has been filled.

During the forward movement of the body 8 together with the associated components, the drive of one or more transport ships is engaged and the propulsion power is transmitted to the body or conveyor island 8 by the transport ship or ships, so that the complete arrangement forms a navigational unit. At the same time the transport ship 15, or transport ships 15, can also take over the navigation of the conveyor island 8, in order to "Mow" the sea bed in strips.

Suitable equipment for the preliminary dressing of the conveyed bulk material may also be provided on the body 8 or pier 12. For example, in the case of the conveying of lumps of manganese it is possible for the lumps to be subjected to a drying operation after removal of excess water and any mud present, for which purpose it is expedient to work in counter-current, that is to say the lumps of manganese are dropped from above and exposed to a counter-current of hot gases, which may for example be the exhaust gases of gas turbines. The material dried in this manner can then be conveyed into a transport ship.

A complete unit is thus formed, which works rationally and continuously.

We claim:

1. Apparatus for extracting valuable materials from the sea bed, comprising a body capable of floating on the sea and carrying equipment by which the material can be extracted from the sea bed during propulsion of the body thereover, a pier adjoining and unitarily connected to the body and arranged to permit the mooring thereto of transport ships to receive the material, and conveyor devices associated with the pier and arranged to convey the material from the body directly into a ship moored to the pier and body, said body being in the shape of a ship's hull, the pier being adjoined and connected to the hull, and the pier being disposed symmetrically to the axis of the body, the body and pier as viewed in plan having the general form of an arrow with the body forming the head of the arrow and the pier forming the shaft of the arrow.

2. The apparatus according to claim 1, including abutments provided in a plurality of positions on said body for frictional connection to a transport ship.

3. The apparatus according to claim 2, wherein the abutments are adjustable.

4. The apparatus according to claim 2, wherein the body tapers towards the pier and the abutments are formed on the tapering portions.

* * * * *